US005454875A

United States Patent [19]

Clarke

[11] Patent Number: 5,454,875

[45] Date of Patent: Oct. 3, 1995

[54] SOFTENING AND PURIFICATION OF MOLASSES OR SYRUP

[75] Inventor: Stephen J. Clarke, Baton Rouge, La.

[73] Assignee: Board of Supervisors of Louisiana State University and Agricultural and Mechanical College, Baton Rouge, La.

[21] Appl. No.: 269,572

[22] Filed: Jul. 1, 1994

[51] Int. Cl.[6] ..... C13D 3/00; C13D 3/12; C13D 3/16; C13F 1/06

[52] U.S. Cl. ..... 127/48; 127/50; 127/55; 127/56; 127/46.1; 127/53

[58] Field of Search ..... 127/48, 50, 55, 127/56, 46.1, 53

[56] References Cited

U.S. PATENT DOCUMENTS

| | | | |
|---|---|---|---|
| 2,000,202 | 5/1935 | Vazquez | 127/47 |
| 2,043,911 | 6/1936 | Ventre | 127/46 |
| 2,379,319 | 6/1945 | Schreiber | 195/11 |
| 2,640,851 | 6/1953 | Miller | 260/527 |
| 3,113,044 | 12/1963 | Alston | 127/48 |
| 3,325,308 | 6/1967 | Othmer | 127/63 |
| 3,563,799 | 2/1971 | Zievers et al. | 127/46 |
| 3,734,773 | 5/1973 | Haley | 127/48 |
| 3,781,174 | 12/1973 | Nishijima et al. | 127/46 A |
| 3,876,466 | 4/1975 | Suzor | 127/46 R |
| 3,887,391 | 6/1975 | Schoenrock et al. | 127/55 |
| 4,101,338 | 7/1978 | Rapaport et al. | 127/48 |
| 4,116,712 | 9/1978 | Othmer | 127/46 R |
| 4,523,959 | 6/1985 | Exertier | 127/55 |
| 4,795,494 | 1/1989 | Toth et al. | 127/50 |
| 5,002,614 | 3/1991 | Miyagi et al. | 127/48 |

OTHER PUBLICATIONS

Paturau, By–Products of the Cane Sugar Industry: An Introduction to Their Industrial Utilization, 3rd Edition, 1989, pp. 395–400 (month not available).

Katzen, "The Alcell® Pulping Process Demonstration Plant," Proceedings 1989: Inter–American Sugar Cane Seminars, vol. 1, pp. 420–421 Sep. 20–22, 1989.

*Primary Examiner*—Christine Skane
*Assistant Examiner*—Patricia L. Hailey
*Attorney, Agent, or Firm*—John H. Runnels

[57] ABSTRACT

A method is disclosed for softening and purifying molasses or syrup to obtain a clarified syrup that can then easily be handled by conventional ion-exclusion or other techniques for recovery of sugar. The process comprises steps that can be performed at ambient temperature. The molasses or syrup is carbonated at high pH, followed by adding organic solvent(s) such as ethanol. The sludge and liquid phases are separated. The solvent is then recovered, leaving a liquid phase comprising a soft and very clear sugar-containing liquid. The liquid phase may then be used in known systems for sugar recovery such as ion-exclusion chromatographic systems. Organic acids such as aconitic acid may be recovered from the sludge residue.

22 Claims, No Drawings

SOFTENING AND PURIFICATION OF MOLASSES OR SYRUP

This invention pertains to the softening and purification of molasses or of a sugar-containing syrup.

Molasses is a concentrated by-product of crystalline sugar production. Final, or blackstrap, molasses is the liquid fraction that remains after sugar (i.e., sucrose) has been crystallized from cane juice, beet juice, or other raw sugar-containing juice through conventional production methods. No further sugar may be recovered from final molasses by standard production methods. Molasses contains a substantial amount of unextracted sugar, along with various inorganic salts, organic salts, and organic polymers. The solid content of molasses is approximately 50% sugar and 50% non-sugar solids. The high sugar concentration of molasses renders it unsuitable for many uses. Further processing typically requires that other means be used for recovering sugar from the molasses (e.g., chromatographic recovery), after which the remaining non-sugar residues may be used, for example, as a fertilizer.

The further extraction of sugar from molasses is hindered by high concentrations of impurities, which quickly foul conventionally-used ion-exclusion resins. Ion-exclusion columns contain a resin of charged, porous beads, usually with sulphonate ions on the surface. Small inorganic ions, such as monovalent ions and divalent anions, do not enter the charged beads, and pass through the column without hindrance. By contrast, small neutral molecules, such as sugar, penetrate the beads and pass more slowly through the column. Thus the sugar is separated from inorganic ions by the difference in their flow rates.

Unfortunately, molasses cannot be applied directly to an ion-exclusion column, due both to high impurity concentrations and to high viscosity. Divalent cations such as calcium and magnesium, which are major impurities in molasses, bind irreversibly to the matrix and degrade the resin, substantially reducing the column's effectiveness. The large organic molecules found in molasses also reduce the effectiveness of the column by adsorbing onto the surface of the resin beads. Finally, the high viscosity of molasses slows the flow rate through the column. The divalent cations may be precipitated by the addition of carbonate under alkaline conditions, but this treatment does nothing to reduce the liquid's unsuitably high viscosity. The molasses remains impractically thick to filter or to apply to an ion-exclusion column effectively.

U.S. Pat. No. 5,002,614 describes a process for extracting cane wax from molasses with an alcohol solvent.

U.S. Pat. No. 4,116,712 describes a process for removing impurities from sugar crystals and syrups by a liquid/liquid phase extraction using a mixture of two solvents, with at least part of the extraction operation preferably being conducted at a pH of 1.25 to 1.30. The preferred solvents are ethanol or acetic acid in combination with acetone. After extractions lime and later carbon dioxide may be added to adjust the pH.

U.S. Pat. No. 3,876,466 discloses reducing the viscosity of a sugar solution by adding aromatic organic sulphonic acids, their salts or derivatives.

U.S. Pat. No. 3,781,174 discloses the production of refined sugar from raw cane juice by continuous carbonation, with active carbon and a combination of ion-exchange resins and ion-exchange membrane electrodialysis.

U.S. Pat. No. 3,734,773 discloses the purification of sugar beet diffusion juice, with recovery of certain organic acids as a by-product, in which carbon dioxide or carbonate ions in hot water are used to precipitate calcium carbonate.

U.S. Pat. No. 3,563,799 discloses the purification of dilute sugar-containing liquids by concentration of the liquid, demineralization in a mixed resin ion-exchange; further concentration, and filtration.

U.S. Pat. No. 3,325,308 discloses the removal of impurities from raw sugar with three successive solvent extraction systems. Methanol is the preferred first solvent, acetone the preferred second solvent, and water the preferred third solvent.

U.S. Pat. No. 2,640,851 discloses the recovery of alkaline earth aconitates from blackstrap molasses through a process using the addition of lime and calcium chloride at high temperatures.

U.S. Pat. No. 2,379,319 discloses the removal of impurities from sugar beet diffusion juice by treatment with a proteolytic enzyme, followed by addition of lime and carbonate.

U.S. Pat. No. 2,043,911 discloses the removal of sulphite impurities added during the manufacture of sugar by adding an oxidizing agent.

U.S. Pat. No. 2,000,202 discloses the recovery of sugar from molasses by adding ethanol and sulphuric acid to remove organic acids, followed by precipitating the sugar with another organic solvent, such as ethyl acetate.

There is a continuing, unfilled need for an efficient, economical method of softening and purifying molasses or sugar-containing syrup, so that additional sugar may thereafter be recovered by standard ion-exclusion technology (or other methods). There is also a need to reduce the waste remaining from the manufacture of sugar, e.g., from the final ion-exclusion system, and to make that waste more acceptable as fertilizer.

A novel and inexpensive method has been discovered for softening and purifying molasses or syrup to a stage where it can be further refined by known techniques such as ion-exclusion to yield refined sugar or sucrose. In the novel process, the molasses or syrup is first diluted (if necessary). Then it is carbonated at high pH (preferably about pH 9.0) to precipitate the divalent cations, primarily calcium. Carbonation may be performed with potassium carbonate, sodium carbonate, or carbon dioxide. Potassium carbonate is the most expensive, but it has the advantage of producing a final waste product after ion-exclusion that is high in potassium, and that is therefore useful as a fertilizer. When potassium carbonate or sodium carbonate is used, the net result is an ion exchange in which the divalent cations are precipitated out, leaving the monovalent cations in solution. (The monovalent ions are separated from the sugar in a later step using an ion-exclusion column.)

The resulting viscous, carbonated mixture is then thinned with an organic solvent such as isopropanol or food-grade ethanol. This organic solvent must be miscible with water, and is preferably on the GRAS (Generally Regarded As Safe) list of the Food and Drug Administration. The solvent also acts to precipitate compounds such as organic polymers, e.g., polysaccharides and proteins. The "sludge" and the supernatant are then separated by filtration or centrifugation. The ethanol or other solvent is then preferably reclaimed from the supernatant and recycled. Sugar may then be extracted from the clear supernatant by known methods, such as ion-exclusion chromatographic recovery. The filtrate or "sludge" may be washed again with ethanol and water in the same ratio to reclaim additional sugar. These washings may also be recycled to the clear liquid stream, and the sludge may be flash-dried to recover the solvent. The precipitated solids may then be disposed or used as fertilizer. Even if these solids must be disposed, the waste problem has nevertheless been reduced, because the solids have a smaller volume than did the original molasses (as well as a smaller volume than results from treating molasses through other prior methods, such as extensive filtration of diluted molasses with a mineral-based filtration aid). The precipitated solids can also be processed to reclaim aconitic acid, a compound found in high concentrations in some molasses including Louisiana molasses. Aconitic acid (1,2,3-propenetricarboxylic acid) is used in the preparation of plasticizers and wetting agents, as an antioxidant, in organic syntheses, as a detergent precursor, and as a flavoring agent. In this novel process, the solubility of the calcium salt of aconitic acid is substantially reduced in the ethanol solution, making recovery by known means more efficient. See, e.g., Paturau, By-Products of the Cane Sugar Industry: An Introduction to Their Industrial Utilization, 3rd Edition, 1989 , pp. 395–400, the entire disclosure of which is incorporated by reference.

The novel method is quick, and is relatively inexpensive because the ethanol or other solvent may be recovered through standard industrial means such as are used in pulping process plants. See, e.g., Katzen, "The Alcell® Pulping Process Demonstration Plant," Proceedings 1989: Inter-American Sugar Cane Seminars, Vol. 1, pp. 420–421, the entire disclosure of which is incorporated by reference. Briefly, the ethanol is recovered by distillation from the sugar solution and from the flash-down precipitation step.

The novel process has several advantages over prior methods: (1) in a single operation, the process both softens the molasses and removes colloids, polysaccharides, other biopolymers such as proteins, some coloring matter and heavy metals; (2) the process uses mild conditions, and avoids high temperatures or severe chemical treatment; (3) use of the novel process requires minimum capital costs, and only simple operating procedures; (4) unlike ion-exchange techniques, the novel process produces no regenerant or effluent; (5) up to 99% of the solvent may be recovered through the use of established technology; (6) the process produces a product of much lower viscosity than is obtained with conventional softening procedures; and (7) certain economically valuable materials may be recovered from the solid phase, such as aconitic acid.

The novel process preferably includes the following steps, all of which may be performed at ambient temperature, or within a temperature range of 20° C. to 60° C., preferably about 30° C.:

(1) The molasses or syrup is diluted, preferably with water, to between about 30 and 70 Brix, preferably about 60 Brix.

(2) The pH of the mixture is adjusted to be within the range 8.0 to 10.0, preferably about 9.0. The mixture may be made alkaline by adding a base such as, for example, sodium hydroxide or potassium hydroxide, preferably potassium hydroxide.

(3) The mixture is slowly carbonateds for example by adding carbon dioxide, sodium carbonate, or potassium carbonate, preferably potassium carbonate. The carbonate:calcium molar ratio should be between about 1:1 and about 1.6:1, preferably about 1.3:1. If carbon dioxide is used, the pH of the mixture should be maintained at about pH 9.0, such as by addition of sodium hydroxide or potassium hydroxide, preferably potassium hydroxide. The mixture is stirred, and divalent cations, primarily calcium, precipitate out.

(4) An organic solvent such as a lower alcohols e.g., isopropanol or ethanold preferably ethanol, is added in a water:solvent ratio by weight between about 1:1 and about 1:5, preferably between about 1:1.5 and 1:2.5, most preferably about 1:2. For example, if the Brix of a 1000 g sugar solution is 60%, then the solution contains 600 g solids and 400 g water. To achieve an water:ethanol ratio of 1:2, 800 g of ethanol would be added to the solution. The solvent may be an azeotropic mixture of the solvent and water, and can be the product of washing step (7) or distillation step (6) below. An alcohol/water mixture or azeotrope may be used by adjusting the molasses concentration in the dilution step so that the final solvent ratios (water:ethanol) are as stated. The solvent addition precipitates organic polymers and thins the mixture. As an alternative solvent system, ethyl acetate may be combined with ethanol to give improved purification; but the resulting three-component ethanol-ethyl acetate-water solvent system is harder to characterize, and solvent recovery is more complex than with ethanol alone.

(5) The precipitated solids are separated by centrifugation or filtration, resulting in about 75–85% by volume supernatant and about 15–25% by volume of "sludge." For most applications, pH adjustment of the clear filtrate with hydrochloric acid to a value between pH 7.5 and pH 8.0 is desirable to minimize color formation during the alcohol-removal stage.

(6) The solvent and water are evaporated from the clear supernatant of step (5) to recycle the solvent, and to obtain a softened, purified, organic-solvent-free syrup of high Brix (approximately 70%). Ethanol recovery by distillation from the clear supernatant follows standard industrial practice, and is preferably performed at or below atmospheric pressure. Since there is no requirement for anhydrous ethanol in this process, the azeotrope produced by distillation at atmospheric pressure (95% ethanol, b.p. 78° C.) is quite suitable. In experiments to date, hardness has been reduced from about 10,000 ppm in the starting molasses to about 500 ppm in the syrup, indicating significant removal of calcium. It has also been observed that organic polymers such as dextran, starch, other polysaccharides, proteins, and colloids were almost completely removed. As a result, the turbidity and color of the syrup were greatly reduced compared to the starting molasses.

(7) The solid "sludge" phase from step (5) may be washed again with the same water:solvent system as in step (4) to reclaim additional sugar. These washings may be used in future purifications at step (4), or they may be flash-dried to recover solvent. Ethanol recovery from the precipitated sludge follows standard industrial practice using a drier and a condensing system with recirculating chilled water to ensure efficient condensation of the vaporized ethanol. The precipitate is then ready for disposal.

EXAMPLES

Final, or blackstrap, molasses collected from various Louisiana sugarcane mills was softened and purified. All steps were conducted at ambient temperature, except for the evaporation step to rid the syrup of ethanol and to recycle the ethanol.

Solids in the molasses were measured in a refractometer as 84 Brix. The molasses was diluted to 60.3 Brix by addition of deionized water. A 1000 g sample of the diluted molasses, pH 5.8, thus contained 397 g water and 603 g solids. The calcium concentration (hardness) was determined by back-titration with EDTA using a Radiometer Autoburette equipped with a calcium-sensitive electrode. Calcium was measured as 7.28 g, or 0.182 moles, equivalent to 7280 ppm in solution, or 12073 ppm on solids. The pH of the sample was adjusted to 9.0 with 28 g of a 10% (w/w) sodium hydroxide solution. The solution was then treated with 150 g of 20% (w/w) sodium carbonate solution (0.283 moles of carbonate ion). Thus the molar ratio of calcium to added carbonate was 1:1.56. The solution then contained 542 g of water. After stirring for fifteen minutes, 1200 g of 95% ethanol was added over a period of five minutes to give a mixture containing water and ethanol in a ratio of 1:1.89 by weight. After stirring for a further fifteen minutes, the mixture was separated by centrifugation to yield 235 g of wet precipitate and 2070 g of clear liquid. The slight loss in total weight was attributed to handling losses.

The wet precipitate was dried in a vacuum oven to give a dry residue of 79 g. The alcohol and some of the water in the clear liquid were removed on a rotary evaporator to give a clear, alcohol-free syrup of 74.6 Brix, weighing 723 g. Thus the weight of the solids in the syrup was 539 g. The calcium content of this syrup was 256 ppm of solids, equivalent to a 97.9% removal of calcium (hardness). Standard tests for polysaccharides in the clear syrup were negative.

Experiments that varied the water:ethanol ratio and the carbonate:calcium ratio demonstrated that more calcium was removed at the higher ratios. Results of some of these experiments are summarized in the following table:

| Ratio Water:Ethanol in treated molasses | Ratio Calcium:Carbonate in treated molasses | Residual Calcium in clear syrup (ppm) |
|---|---|---|
| 1:1.65 | 1:1.37 | 837 |
| 1:1.89 | 1:1.56 | 256 |
| 1:2.01 | 1:1.25 | 679 |
| 1:2.02 | 1:1.50 | 294 |

The entire disclosures of all references cited in the specification are hereby incorporated by reference in their entirety. In the event of an otherwise irresolvable conflict; however, the present specification shall control.

I claim:

1. A process of depleting calcium or magnesium cations and organic polymers from a molasses or a syrup comprising sucrose, calcium or magnesium cations, and organic polymers, the process comprising the steps of:

(a) adding a base to adjust the pH of the molasses or syrup to be between about 8.0 and about 10.0;

carbonating the molasses or syrup with carbonate or carbon dioxide to precipitate calcium or magnesium cations;

(c) adding to the molasses or syrup a solvent comprising isopropanol or ethanol, to thin the molasses or syrup and to precipitate the organic polymers, whereby a liquid phase and a sludge phase are formed;

(d) separating the liquid phase from the sludge phase, whereby the liquid phase is depleted of calcium or magnesium cations and organic polymers.

2. A process as recited in claim 1, wherein the recited steps are performed in the recited order: step (a) first, step (b) second, step (c) third, and step (d) fourth.

3. A process as recited in claim 2, wherein each of said steps is performed within a temperature range between about 20° C. and about 60° C.

4. A process as recited in claim 3, wherein each of said steps is performed at a temperature of about 30° C.

5. A process as recited in claim 2, wherein the pH of the molasses or syrup is adjusted to about 9.0.

6. A process as recited in claim 2, wherein prior to said pH adjusting step the molasses or syrup is first diluted with water to a solids level between about 30 Brix and about 70 Brix.

7. A process as recited in claim 6, wherein prior to said pH adjusting step the molasses or syrup is first diluted with water to a solids level of about 60 Brix.

8. A process as recited in claim 2, wherein said pH adjusting step is performed by adding sodium hydroxide to the molasses or syrup.

9. A process as recited in claim 2, wherein said pH adjusting step is performed by adding potassium hydroxide to the molasses or syrup.

10. A process as recited in claim 2, wherein said carbonating step is performed by adding carbon dioxide to the molasses or syrup.

11. A process as recited in claim 2, wherein said carbonating step is performed by adding sodium carbonate to the molasses or syrup.

12. A process as recited in claim 2, wherein said carbonating step is performed by adding potassium carbonate to the molasses or syrup.

13. A process as recited in claim 2, wherein said solvent comprises ethanol.

14. A process as recited in claim 13, wherein said solvent additionally comprises ethyl acetate.

15. A process as recited in claim 2, wherein said separating step is performed by filtration.

16. A process as recited in claim 2, wherein said separating step is performed by centrifugation.

17. A process as recited in claim 2, additionally comprising the step of adjusting the pH of the separated liquid phase to be between about 7.5 and about 8.0.

18. A process as recited in claim 2, additionally comprising the step of removing the solvent from the liquid phase.

19. A liquid phase produced by the process of claim 18.

20. A liquid phase produced by the process of claim 2.

21. A sludge phase produced by the process of claim 2.

22. A process as recited in claim 2, additionally comprising the step of recovering aconitic acid from the sludge phase.

* * * * *